US010262817B2

(12) United States Patent
Wareham et al.

(10) Patent No.: US 10,262,817 B2
(45) Date of Patent: Apr. 16, 2019

(54) KEYPAD WITH REPLACEABLE KEY LABELS

(71) Applicant: DYNAGEN TECHNOLOGIES, INC., Dartmouth (CA)

(72) Inventors: Paul Wareham, Bedford (CA); Richard Robert Coulson, Markham (CA); Wesley Warren Manning, Eastern Passage (CA); Sean Nutter, Enfield (CA)

(73) Assignee: DYNAGEN TECHNOLOGIES INCORPORATED, Dartmouth (CA)

( * ) Notice: Subject to any disclaimer, the term of this patent is extended or adjusted under 35 U.S.C. 154(b) by 0 days.

(21) Appl. No.: 15/910,144

(22) Filed: Mar. 2, 2018

(65) Prior Publication Data

US 2018/0197702 A1 Jul. 12, 2018

Related U.S. Application Data

(63) Continuation of application No. 15/478,329, filed on Apr. 4, 2017, now Pat. No. 10,056,207.

(60) Provisional application No. 62/318,900, filed on Apr. 6, 2016.

(51) Int. Cl.

| | |
|---|---|
| ***H01H 9/26*** | (2006.01) |
| ***H01H 13/83*** | (2006.01) |
| ***H01H 13/705*** | (2006.01) |
| ***H01H 3/00*** | (2006.01) |
| ***H01H 13/86*** | (2006.01) |

(52) U.S. Cl.

CPC ..... *H01H 13/83* (2013.01); *H01H 3/00* (2013.01); *H01H 13/705* (2013.01); *H01H 13/86* (2013.01); *H01H 2219/002* (2013.01); *H01H 2219/004* (2013.01); *H01H 2219/006* (2013.01); *H01H 2223/002* (2013.01)

(58) Field of Classification Search

CPC ..... H01H 13/86; H01H 13/00; H01H 13/705; H01H 13/83; H01H 2219/006; H01H 2219/004; H01H 2219/002; H01H 2223/002

USPC ..... 200/5 A

See application file for complete search history.

(56) References Cited

U.S. PATENT DOCUMENTS

| | | | |
|---|---|---|---|
| 4,096,364 | A | 6/1978 | Lynn et al. |
| 4,694,725 | A | 9/1987 | Seevers |
| 5,367,133 | A | 11/1994 | Schmidt et al. |
| 5,612,692 | A | 3/1997 | Dugas et al. |
| 6,762,381 | B2 | 7/2004 | Kunthady et al. |
| 7,283,066 | B2 | 10/2007 | Shipman |

OTHER PUBLICATIONS

Powerkey Pro Product Accessory Catalog.

*Primary Examiner* — Anthony R Jimenez
(74) *Attorney, Agent, or Firm* — ABM Intellectual Property Inc.; Adrienne Bieber McNeil

(57) ABSTRACT

A key able to accept a label for a keypad used in controlling electrically operated devices, wherein the key structure accepts and secures an interchangeable label, and which forms an impermeable barrier to the electrical contacts of a programmable circuit board.

17 Claims, 7 Drawing Sheets

KEYPAD WITH REPLACEABLE KEY LABELS

CROSS-REFERENCES TO RELATED APPLICATIONS

This application is a continuation of U.S. patent application Ser. No. 15/478,329 filed on Apr. 4, 2017, which claims the benefit of U.S. Provisional Patent Application No. 62/318,900, filed on Apr. 6, 2017. Each of the aforementioned applications is incorporated herein by reference in its entirety.

BACKGROUND OF THE INVENTION

Field of the Invention

The present invention relates to a keypad for electrically controlling equipment wherein the push button keys have a replaceable label component affixed to the key and where the keypad is completely sealed from environmental hazards.

Background and Related Art

For manufacturers and users of electrical devices operated through a keypad, there is often a problem with making the keypad adaptable to the device with which it interfaces, for example, when switches may be reconfigured or reprogrammed, because the device is being sold to users of a different language, or the application has changed. To make a keypad more adaptable, it would be desirable to have a method of changing the visual cues, such as the color or marking of a label on the individual keys of a keypad. Another problem is that keypads designed to exclude environmental hazards by having a continuous keypad covering, when manufactured using flexible material, may not provide mechanical, tactile, or audible feedback when actuated to make or break a circuit.

U.S. Pat. No. 5,367,133 "Keypad Including Membrane with Replaceable Key Element" is one example of a keypad having changeable key markings; however, this was achieved by removing and replacing the entire button portion of the key making the operation of the switch unusable at that position if lost.

Keypads such as the PowerKey Pro available from Digital Switching Systems LLC, Raleigh, N.C., USA are other examples of re-allocatable keypads for use in heavy duty settings. The PowerKey Pro contains removable button components but if removed, the button becomes inconvenient to use. Further, the attachment method lacks a locking mechanism to prevent accidental removal and loss of a key.

It is desirable to provide a type of button or key member for a keypad that can be useable, durable, and sealed against the environment (water, dust, caustic materials, etc.) but that can have a removable label piece capable of being removed or added easily and that would allow the user to label the button as desired for clarity of purpose.

SUMMARY OF THE INVENTION

The following summary is intended to introduce the reader to various aspects of the detailed description, but not to define or delimit any invention.

The present invention provides a key for housing and addressing a switch element, wherein a key comprises a main piece on one side of a keypad surface protecting membrane and a switch actuating piece on the opposite side of the membrane and where the main piece is formed to accept and to shield a replaceable label component for conveying the function of the key to the operator.

In one embodiment, the present invention provides a keypad on a programmable control panel having a circuit board where the individual keys can have different functionality depending on the application and programming of the control panel. The control panel can be used in heavy duty or hazardous applications where it is desirable for any indicium or text on the key to be easily replaceable and durable and for the keypad to be impermeable and protect the electrical switches within the circuit board. In one embodiment, the present invention provides a keypad for actuating switch elements controlling multiple modes or functions of an electrically operated device, comprising: a membrane, having a plurality of shaped keys integral to the membrane, whereby pressing of the key causes flexing of the membrane and actuation of a switch element having a defined function; and where a key comprises a main piece on one side of the membrane and a switch actuating piece on the opposite side of the membrane and where the main piece is formed to accept and to shield a replaceable label component for conveying the function of the key to the operator.

In another aspect of the invention, a kit containing interchangeable label pieces compatible with a key piece of the invention is provided. In one aspect, the kit comprises a keypad with one or more key pieces and compatible label pieces able to be secured to the key piece and being replaceable by the user, the kit further comprising written instructions for the method of changing and, optionally, marking the label pieces.

DESCRIPTION OF THE FIGURES

The drawings included herewith are for illustrating various examples of articles, methods, and apparatuses of the present specification and are not intended to limit the scope of what is taught in any way. In the drawings.

DETAILED DESCRIPTION OF THE INVENTION

Figure 1:
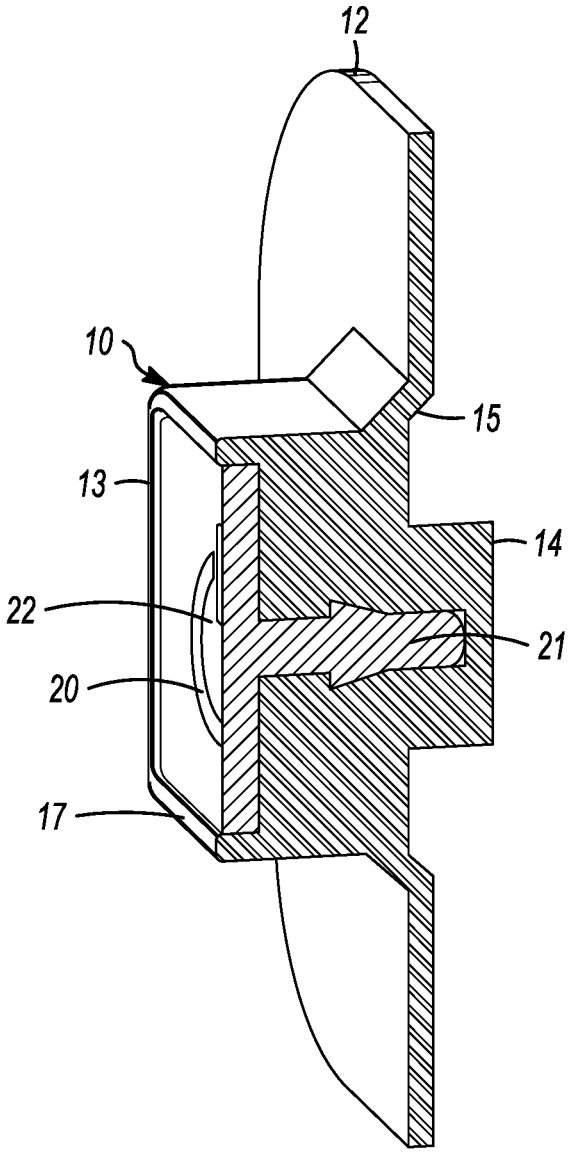
FIG. 1 is a drawing of a cross section of a key according to the invention showing an example of a label piece being secured to the key with a barbed retainment post (21)

Various apparatuses or processes will be described below to provide an example of an embodiment of the claimed subject matter. No embodiment described below limits any claim and any claim may cover processes or apparatuses that differ from those described below. The claims are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any subject matter described below and for which an exclusive right is not granted by issuance of this patent application may be the subject matter of another protective instrument, for example, a continuing patent application, and the applicants, inventors or owners do not intend to abandon, disclaim or dedicate to the public any such subject matter by its disclosure in this document.

In order that the present invention may be more readily understood, certain terms are first defined. Additional definitions are set forth throughout the detailed description.

All publications, including but not limited to patents and patent applications, cited in this specification are herein incorporated by reference as though fully set forth.

Definitions

A "marking" or "indicium" may be text, a letter, abbreviation, or a symbol (such as an arrow) that cues the user of the key or keypad as to the function controlled by the underlying switch.

The term "switches" (or "switch elements") means a single point of mechanically operable electrical connection (or interruption).

A "key" (also known as a button) is located on a control panel face (the "keypad") that is accessible to the user and to environmental conditions. The keys and keypad area are sealed. The key may be partially or fully translucent such that backlighting provides a means for enhancing the recognizability of the location or function of the key. The key will have a label portion which may further be marked by an opaque or semi-opaque symbol or some other indicium, alternatively or in addition, the label portion of the key may have a raised feature to indicate the function. A visible indicium such as text, a symbol, or a color marks the key such that the user is advised of the key's function or purpose. A raised feature, such as, but not limited to a pattern of dots or ridges, may provide a means by with the function of the key can be detected tactilely. The main key piece seals and protects the switches and also serves to provide a suitable surface for the user to push against for user comfort and convenience. In an embodiment, the main key piece material is continuous with an elastomeric membrane covering the keypad, which when positioned within the keypad housing, provides protection against environmental or mechanical damage to the electrical components of the keypad and underlying circuits.

The invention improves on the prior art with the following:

1. Only a small portion of the key, designated the label piece (also referred to as the 'label component') is removable allowing the key to maintain position and functionality even in the absence of the label piece. This is important for critical applications that require use of the key.

2. The key label piece is secured to the key. In one embodiment, the method of securing the label piece to the key is with a barbed locking mechanism that securely locks the label piece to the main piece. Further provided are features for aligning or orienting the label on the main piece of the key such as an alignment hole.

3. The label piece is guarded on all sides by the main key piece such that no accidental force (e.g. rubbing or brushing action) can accidently remove the key.

Figure 7:
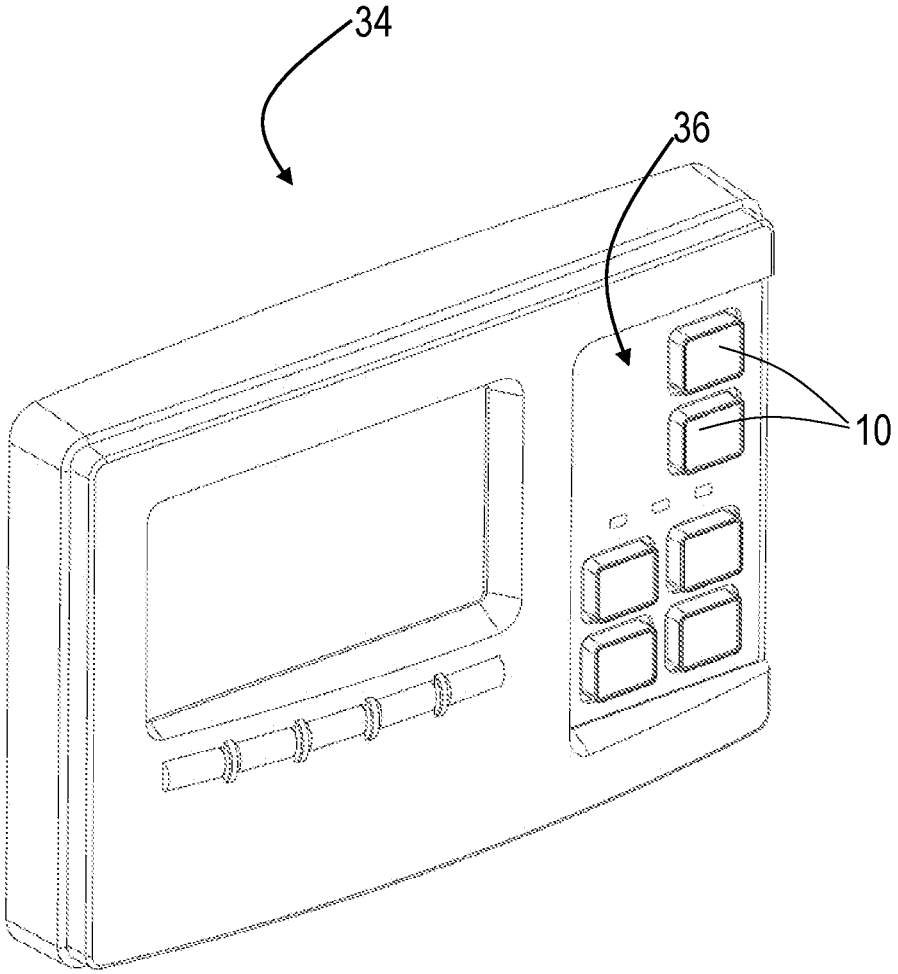
FIG. 7 is a perspective view of an example programmable control panel 34.

An example of a programmable control panel 34 comprising the keypad 36 of the invention is shown in FIG. 7. An example of a key 10 of the keypad 36 is shown in FIG. 1. The keypad 36 would consist of one or a plurality of keys 10 such as the one shown in FIG. 1, where each key 10 is sealed to and continuous with an impermeable, elastomeric membrane 12, and has a main piece 13 emerging from the plane of the membrane 12 on one side of the membrane and has a switch actuating piece 14 extending from the plane of the membrane opposite the main piece. In the region immediate adjacent to the main key piece 13, the thickness of the material of membrane 12 may be thinner to allow movement of the main key piece (i.e. the key press and release movement). The seal 15 between the key and the membrane may be of a thickness to provide stability to the key.

Figure 6A:
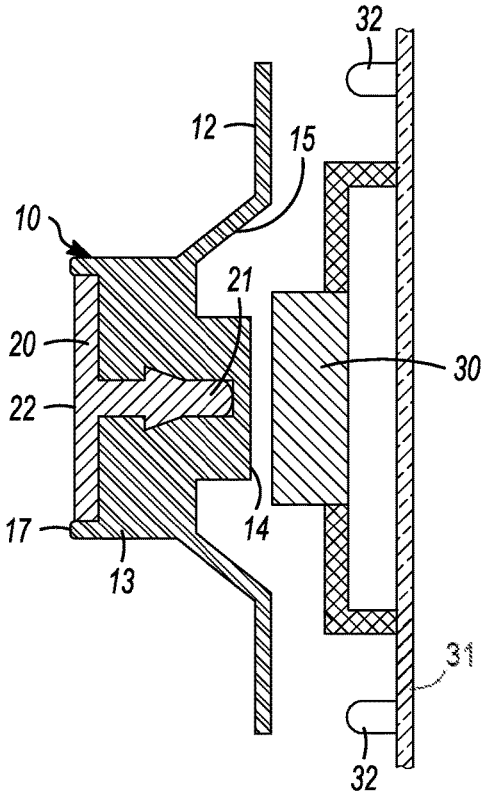
FIG. 6A is a cross-section showing the key 10 of FIG. 1 spaced from a circuit board 31, in a non-depressed shape.
Figure 6B:
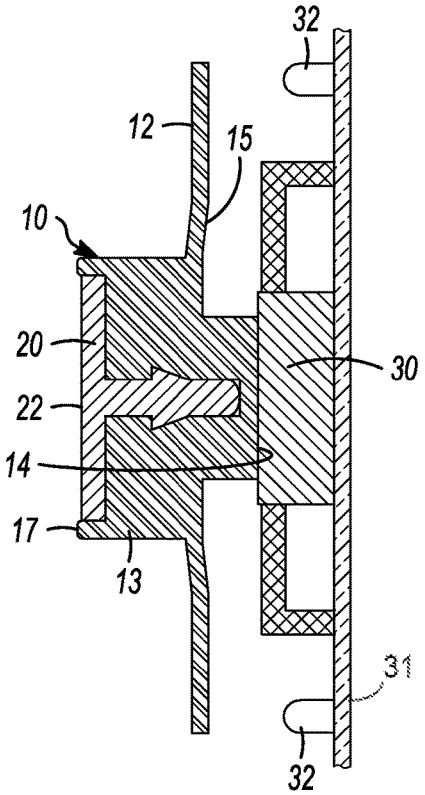
FIG. 6B is a cross-section showing the key 10 of FIG. 1 pressed towards a circuit board 31, and in a depressed shape.

In one embodiment of the method of operating the invention, the user actuates the tactile switch 30 indirectly by depressing the main piece 13 which is made of flexible material, applying enough force to the key so that the switch actuating piece 14 actuates the tactile switch 30 mounted to the circuit board 31 (as shown in FIG. 6B) where the tactile switch, once contact has been made, has the ability to snap or spring back (to the position shown in FIG. 6A) providing both a mechanical (tactile) and audible (click) feedback signal to the user.

Figure 2:
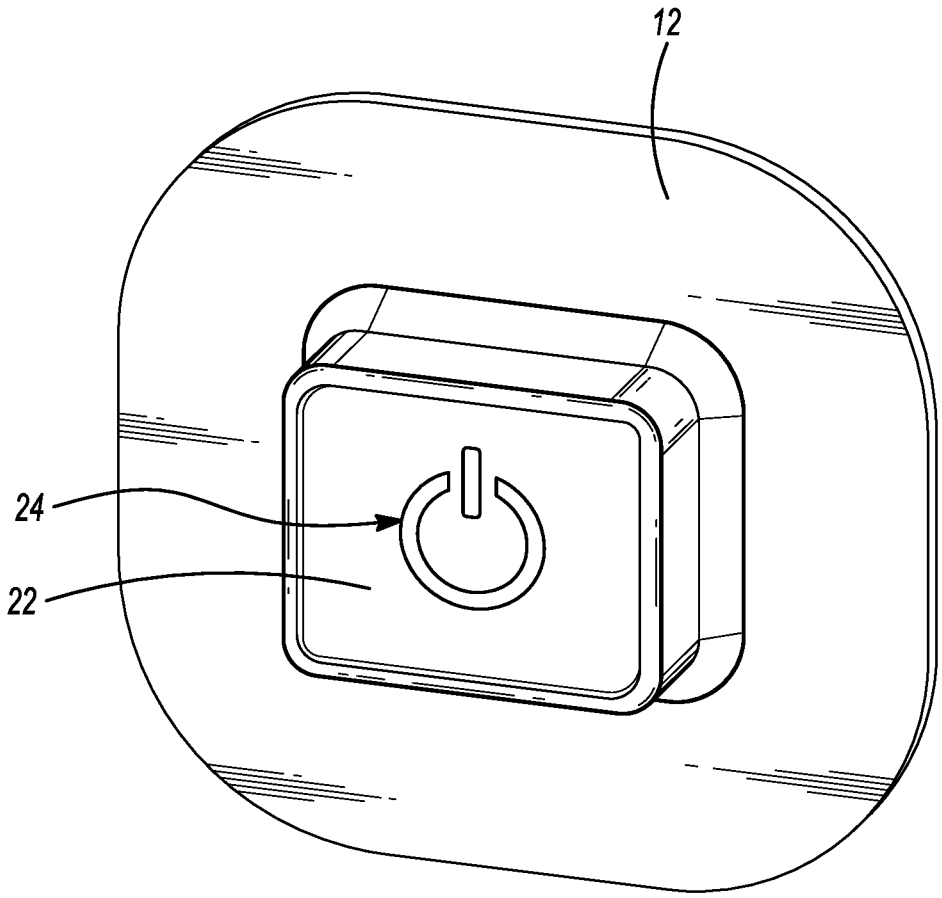
FIG. 2 is a drawing of a top view of a key according to the invention showing a translucent label piece having an opaque symbol therein (24)

In an embodiment, the user is cued to the individual functions of the switches of the keypad by a label piece 20 affixed to the main piece where the label piece, when secured to the main piece, has only the one visible and contactable surface 22, being shielded by the protruding sides 17 of the main piece 13. FIG. 2 shows a key with a label piece with an indicum 24 marked nontransparently thereon and affixed to a key. When a key as shown in FIG. 2 has a translucent core, surface 22, maybe illuminated and the indicium 24, being opaque, remains visible.

In order to increase the visibility of the key and its function to the user, in one embodiment, the key may be constructed having a fully translucent or partially translucent inner core 16 (FIG. 3) with the label piece 20 being translucent or partially translucent and, optionally, being colored or having an opaque mark or symbol or other indicium conveying the function of the key to the user. In the case of a keypad comprising translucent or partially translucent keys, the keypad will be backlit. In one aspect, a key with a colored label piece can be partially translucent such that it could mimic an indicator lamp to be used to indicate the status of the underlying switch.

Figure 3:
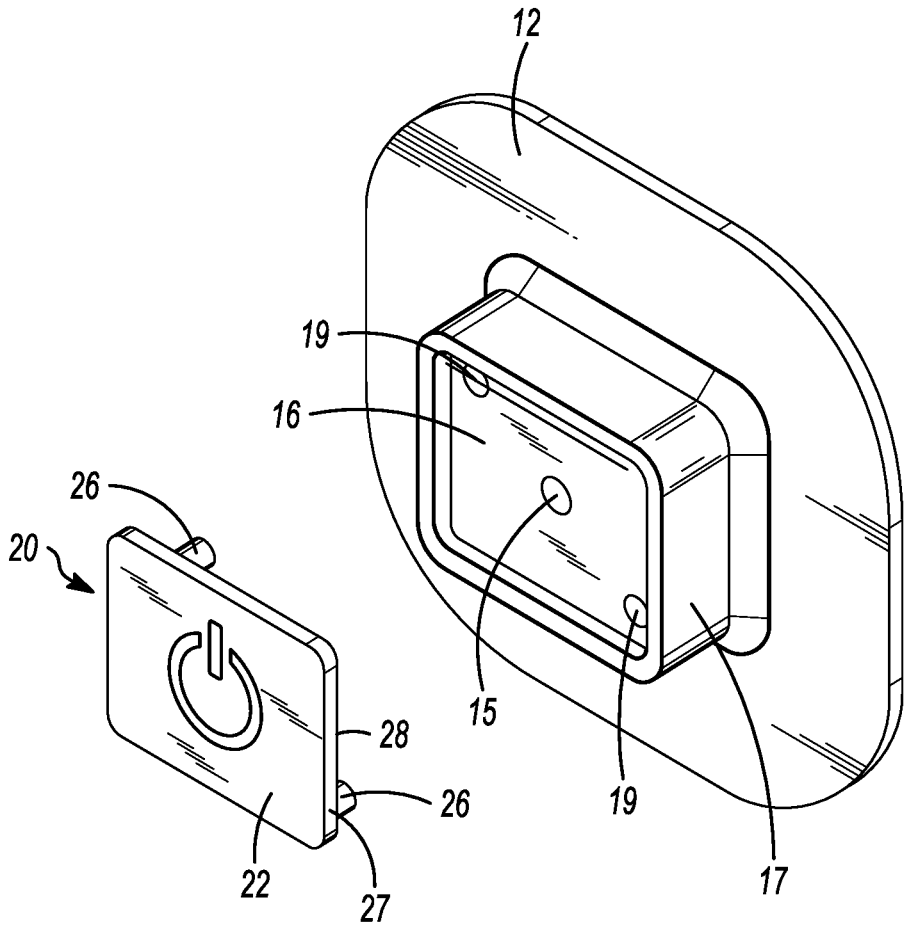
FIG. 3 is a drawing of a key according to the invention showing an example of optional insertion or alignment features on the label and the main piece in a key, such as an insertion hole (15) for accepting a retainment post and alignment holes (19) for insertion of alignment pins (26) on surface (28) of the label piece.

Referring to FIG. 3, label piece 20 is made of a rugged material which is also, optionally, elastomeric and may have a smooth or nonsmooth surface which is substantially a flat surface 22 for contact by the user, sides 27 and, a substantially flat back 28. In one aspect, for better engagement and to prevent slipping, surface 22 of the label piece may be ridged or coated with fine granules, have a slightly raised grid design, or any feature known in the art for preventing slipping once the user intentionally contacts the key. In order to align and, where necessary, orient the label on the main piece of the key, the label piece may have alignment pins 26 or knobs protruding from back surface 28 making contact with the main piece. In another aspect, the label piece may have one or more members projecting outward from side back surface 28 that will be placed within the key main piece, where the projecting feature is intended to engage a cavity such as insertion hole 15 in the key, which cavity may extend from the main piece through the plane of the membrane into the switch actuating piece as depicted in FIGS. 1 and 3. In one embodiment, the projecting member is a barbed retainment post 21 as shown in cross section in FIG. 1, or the retainment post may have multiple barbs that encompass all or a portion of the post. In another aspect, the post has an encircling flange that locks into the key, or has a bulbous end, such as a teardrop shape, where the shape of the post is mirrored by a lip or shaped cavity in the main piece of the key. In one aspect, the retainment post is press fit to the key main piece. In another aspect, the feature projecting from the back surface of the label piece is one or more prongs that may be parallel or inclined towards or away from one another, and may further be smooth, ridged or toothed. In another aspect, the feature projecting from the back surface of the label piece is unitary with the label piece. In further aspect, the feature projecting from the back surface of the label piece is comprised of a different material than the of the label piece and is affixed thereto by fusion, adhesive, or fits within a casing formed in the label piece.

In an embodiment, the label piece is completely encircled and shielded on side surfaces 27 by protruding sides 17 (FIGS. 1 and 3) of the main piece 13 of the key. Together, the contact between ridges, alignment pins, and, optionally, a retainment post allow for the secure and exact positioning of the label piece to the key but also allow the label piece to be removed and replaced as needed due to change in the function of the key to which it is affixed or for another reason such as use by an operator preferring the label have another feature be it the indicator symbol, text, color or the like.

Figure 4:
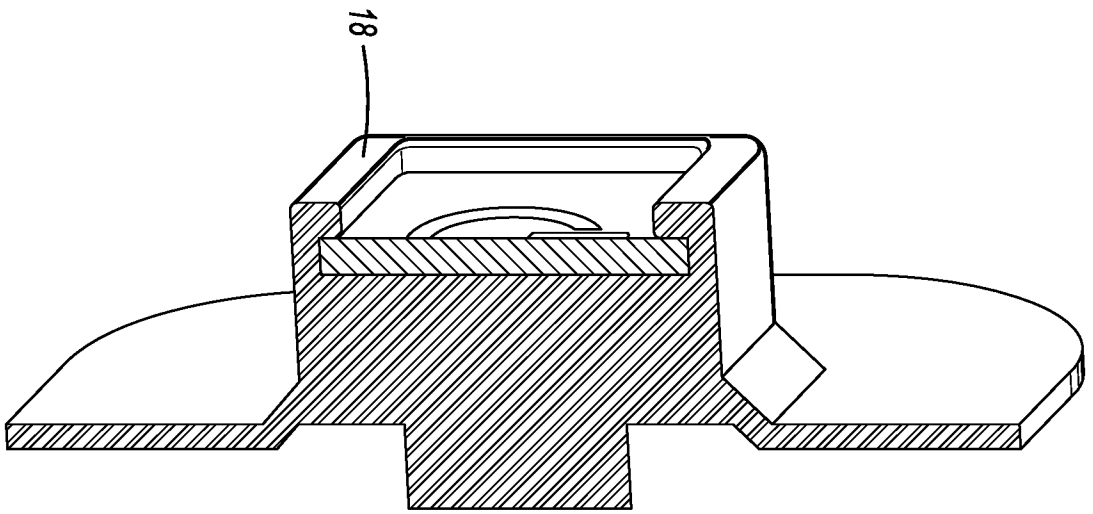
FIG. 4 is a drawing of a key according to the invention showing an example of key wherein the sides of the main piece form a flange (18) capable of overlapping the contact surface of the label piece.
Figure 5A:
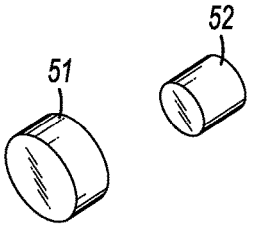
FIG. 5A shows polarly oriented magnets 51 and 52.
Figure 5B:
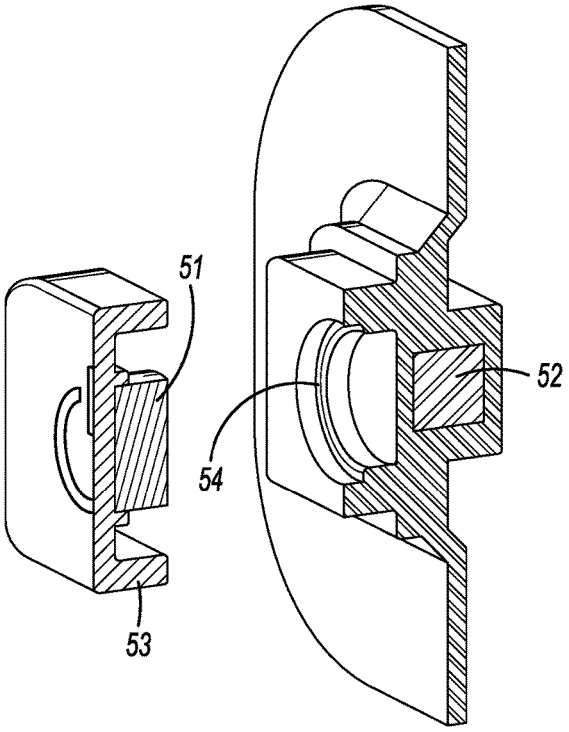
FIG. 5B shows magnet 51 affixed to the label piece and held by flange 53 thereon and the magnet receiving space 54 within key piece.
Figure 5C:
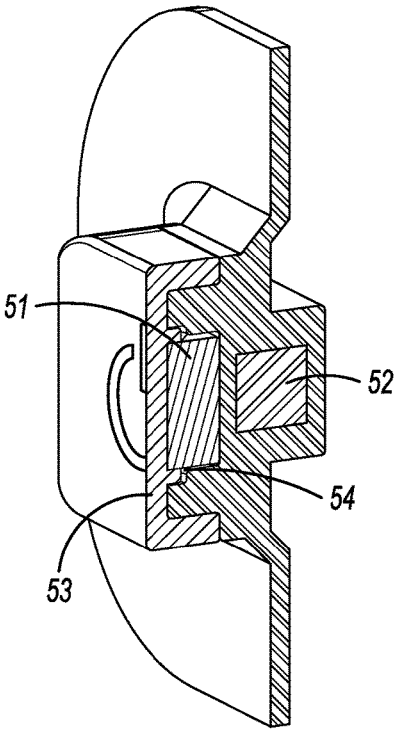
FIG. 5C shows the label piece attracted to magnet 52 embedded in the base of the key.

In another embodiment, the label piece is secured to the main piece by flanges 18 that overlap the label piece formed by elevated side surfaces that overlap a portion of the surface of the label piece (FIG. 4). In another embodiment as shown in FIG. 5, the label piece comprises a flange 53 that protrudes into the main piece of the key at an accommodating space 54 that is of a diameter to encompass a small magnet 51, the key portion having embedded within it, a second magnet 52 whereby both magnets are oriented such that the opposite polarity of the two magnets encourages and secures contact between the label piece and the main piece of the key as shown in FIG. 5A-C. In one aspect, the magnets are strong permanent magnets, such as, but not limited to, those composed of an alloy containing a rare-earth element, especially neodymium and samarium-cobalt.

It is further noted, that the design of the main piece of the key and, when present, the seal with the keypad surface covering membrane form an impermeable barrier between keypad and the underlying electrical contacts with or without the presence of the label piece. Therefore, the operation of the device or equipment in the absence of one or more labels of the keypad is not compromised.

The membrane and the keys and the label component can be constructed or formed from any suitable material known in the art providing that the material is capable of forming a continuous and impermeable barrier that will protect electrical switches from unwanted electrical conduction or failure otherwise. In one embodiment, the membrane is made of black silicone and the keys are placed through and sealed to the black silicone.

In an embodiment, there is provided a key or keys with a label piece or indicium capable of illumination. An example of a keypad comprising keys of the present invention is one with a light channeling membrane and preferably key members constructed at least partially of translucent material so that light produced from a light source is channeled upwardly to the upper surfaces of the key members. The light source may include LED (light emitting diode) 32 (as shown in FIGS. 6A and 6B) or LEC (light-emitting electrochemical cell) or LCD (liquid crystal display) systems in adjoining relationship to the light channeling membrane or a light pipe. In an embodiment, the light source is a substantially planar luminescent sheet which underlies the light channeling membrane. In an alternate embodiment, the source of illumination may be a light pipe constructed to illuminate light laterally along a portion of its length to illuminate a plurality of key members.

Methods of Using the Invention

The key or keys of the present invention are useful as an array or keypad interfacing with a printed circuit board in an electrical device. In one embodiment, each key of the keypad is of a minimum size and depth and comprised of such a material as to be able to engage the switch elements while accommodating the label piece and key piece elements required to engage and secure the label piece such as a barb or alignment elements. In another embodiment, the keypad is used in a sealed heavy duty control panel. In one aspect, the control panel is used to operate heavy duty equipment in a manufacturing plant, such as equipment capable of repeated movements. In another embodiment, the keypad is used in a setting where the operator repeatedly uses fluids incompatible with electrical switches, such a technician involved in operating imaging equipment after applying electrically conductive fluids or gels to a patient. It is understood that the above embodiments are given for illustrative purposes and in no way are to be construed as limiting the possible applications of the present inventions disclosed herein.

In one embodiment, the keypad interfaces with a printed circuit board having a plurality of dual channel switch sites thereon. The keys of the keypad may actuate the switch at the switch site either by directly making a conductive contact or making conductive contact by transferring force to a conductive element. One example of manner in which a key on the keypad may make indirect contact is as described in U.S. Pat. No. 5,612,692; by interacting with dome-shaped conductive resilient elements generally called domes that act cooperatively with the keys, which in their relaxed state maintain the switch open, and in their depressed and tripped state close the switch. The domes provide a point of engagement by an actuator or key which in turn engages contacts on the switch site.

In another aspect of the invention, a kit comprising one or more key elements formed to accept and retain a label piece is assembled wherein the kit further comprises one or more label pieces compatible for use with the particular key shape in the kit. In one embodiment, the kit contains key pieces and an equal or greater number of insertable label pieces which are premarked according to functions routinely controlled by a keypad. Exemplary, but nonlimiting functions for which label pieces could be marked are: AUTO, RUN, OFF, RPM UP, RPM DOWN, and LOAD/UNLOAD. It will be understood that in many cases, instead of text based markings universal symbols or any marking preferred by the operator may be used to designate functions marked on the label pieces.

While having described the invention in general terms, the embodiments of the invention will be further disclosed in the following examples. The selection and application of certain configurations, materials, and uses of the present invention are not limited to the examples presented herein.

Example 1: Keypad with Flexible Keys and Tactile Switch Interface

A key 10 is mounted to the circuit board 31 or other suitable surface, and has a main key piece which is flexible enough to trigger the tactile switch 30 when pushed by the user (as shown in FIG. 6A) and rigid enough to spring back to the pre-depressed shape when the underlying tactile switch 30 is released by the user (as shown in FIG. 6B). The keypad consists of keys such as the one shown in FIG. 1, where each key 10 is sealed to and continuous with an impermeable, elastomeric membrane 12, and has a main piece 13 emerging from the plane membrane 12 on one side of the membrane and has a switch actuating piece 14 extending from the plane of the membrane opposite the main piece. In the region immediately adjacent to the main key piece 13, the thickness of the material of membrane 12 may be thinner to allow movement of the main key piece (i.e. the key press and release movement). The silicon keypad (12) is about 2 to 2.5 mm in thickness at maximum thickness and 1 to 1.2 mm at minimum thickness. It is made of silicon rubber shore 50 A. The button portion of the keypad (17) projects from the flat main portion of keypad (12) about 4 to 5 mm. The seal (15) between the key and the membrane may be of thickness to provide stability to the key.

As shown in FIGS. 6A and 6B, the user actuates the tactile switch 31 indirectly by depressing the main piece 13 which is made of flexible material, applying enough force to the key 10 so that the switch actuating piece 14 actuates the tactile switch 30 mounted to the circuit board 31 where the underlying tactile switch 30, once contact has been made, has the ability to snap or spring back providing both a mechanical (tactile) and audible (click) feedback signal to the user.

Example 2: Label Piece Having a Barbed Retainment Post

In order to secure the label portion to the key, the label piece may be formed so that an element protrudes from the surface opposite the contact surface. The contact surface is marked so that the operator will contact a key when the indicated function related to the switch function marked is needed. FIG. 1 illustrates a key having a label with a barbed retainment post for insertion and retainment in the key. Label piece (20) with retainment post (21) extension is made of elexan PC (poly carbonate) glossy material where the flat key contact surface (22) is about 1.5 to 2 mm thick. The total height of the label piece from the key surface (22) to the retainment post tip is about 10 mm and the key is 12 mm high by 15 mm wide. The barb is about 3.5 mm in diameter at its thickest and tapers out at 2 mm in diameter and tapers out over a length of about 3 mm and maintains 2 mm diameter for another 2 mm before ending.

As shown in FIG. 3, the label piece may further have alignment pins (26) which are each 7 mm from the center of barb (21), project 2 mm out from back of key surface (22) and are 2 mm in diameter. The sides (28) of the label piece contact surface (22) fit within the raised ridges of the sides (17) of the main key piece and the alignment pins of the label piece insert into insertion holes (19) in the main key piece where label undersurface (28) makes contact.

Example 3: Translucent Key Configuration

The user is cued to the individual functions of the switches of the keypad by a label pieces affixed to the main piece of each key, where the label piece, when secured to the main piece, has only the one visible and contactable surface, being shielded by the protruding sides of the main piece and both the label piece and the core of the key are made of translucent material making it possible for the surface to be illuminated and the black opaque symbols imprinted with the translucent label material to be readily visible.

While the above description provides examples of one or more processes or apparatuses, it will be appreciated that other processes or apparatuses may be within the scope of the accompanying claims.

To the extent any amendments, characterizations, or other assertions previously made (in this or in any related patent applications or patents, including any parent, sibling, or child) with respect to any art, prior or otherwise, could be construed as a disclaimer of any subject matter supported by the present disclosure of this application, Applicant hereby rescinds and retracts such disclaimer. Applicant also respectfully submits that any prior art previously considered in any related patent applications or patents, including any parent, sibling, or child, may need to be re-visited.

We claim:

1. A programmable control panel for combustion engines or electrical equipment, comprising:

a circuit board having a plurality of tactile switch elements, wherein each tactile switch element is programmable to carry out a respective function upon actuation, and is configured to return to a respective original position upon release;

a keypad having a membrane and a plurality of keys integral with the membrane, wherein each key has a respective main piece on one side of the membrane and a respective switch actuating piece on an opposite side of the membrane, wherein for each key, the switch actuating piece contacts and actuates a respective one of the tactile switch elements upon depression of the key and each key returns to a non-depressed shape upon release of the key, and whereby actuation of the tactile switch elements by the keys and/or release of the tactile switch elements from the keys provides feedback to the operator via the keys; and a plurality of replaceable and interchangeable label components, the label components removably mountable to the main pieces of keys to convey the function of the underlying tactile switch of each respective key to an operator.

2. The programmable control panel of claim 1, wherein both actuation of the tactile switch elements by the keys and release of the tactile switch elements from the keys provide tactile feedback to the operator via the keys.

3. The programmable control panel of claim 1, wherein a region of the membrane adjacent the main pieces of the keys has a first thickness, and a region of the membrane spaced from the main pieces of the keys has a second thickness, and the first thickness is greater than the second thickness.

4. The programmable control panel of claim 1, wherein for each key, the main piece has a main piece thickness, the switch actuating piece has a switch actuating piece thickness, and the main piece thickness is greater than the switch actuating piece thickness.

5. The programmable control panel of claim 1, wherein at least some of the keys comprise a translucent or transparent key portion;

at least some of the label components comprise a translucent or transparent label portion; and the programmable control panel further comprises a light source underlying the keypad.

6. The programmable control panel of claim 1, wherein at least some of the keys are illuminatable by a light source underlying the keypad, and illumination of a given one of the keys indicates a status of the tactile switch element associated with the given one of the keys.

7. The programmable control panel of claim 1, wherein:

each key comprises a respective insertion hole; and each label component comprises a respective label piece and a respective retainment post extending from the label piece for insertion into a respective one of the insertion holes.

8. The programmable control panel of claim 7, wherein for each key the insertion hole extends from the main piece into the switch actuating piece.

9. The programmable control panel of claim 7, wherein for each key:

the switch actuating piece comprises a switch actuating surface for contacting the respective one of the tactile switch elements;

the retainment post has a respective post distal end; and when the retainment post is inserted into the respective one of the insertion holes, the post distal end is proximate the switch actuating surface.

10. The programmable control panel of claim 7, wherein:

each label component further comprises a contact surface, a back surface opposite the contact surface, and an alignment pin extending from the back surface and spaced from the retainment post; and each main piece further comprises an alignment pin insertion hole for receiving the alignment pin.

11. The programmable control panel of claim 1, wherein each switch actuating piece comprises an integral switch actuating surface for contacting the respective one of the tactile switch elements without making direct electrical contact with the respective one of the tactile switch elements.

12. The programmable control panel of claim 11, wherein each switch actuating piece is fabricated from an elastomeric material.

13. A method of using a programmable control panel for combustion engines or electrical equipment, comprising:

a. programming a tactile switch element of a circuit board to carry out a function upon actuation;

b. removably mounting a label that is indicative of the function to a main piece of a key of a keypad;

c. depressing the key to actuate the tactile switch element with a switch actuating piece of the key;

d. releasing the key to allow the key to return to a non-depressed shape and to allow the tactile switch element to return to an original position;

e. removing the label from the main piece of the key;

f. programming the tactile switch element to carry out another function upon actuation; and g. removably mounting another label indicative of the other function to the main piece of the key;

whereby actuation of the tactile switch elements by the key and/or return of the tactile switch element to the original position provides feedback to an operator via the key.

14. The method of claim 13, wherein both actuation of the tactile switch element by the key and return of the tactile switch element to the original position provide feedback to an operator via the key.

15. The method of claim 13, wherein step b. comprises inserting a retainment post of the label piece into an insertion hole of the key.

16. The method of claim 13, wherein step b comprises inserting an alignment pin of the label piece into an alignment pin insertion hole of the key.

17. The method of claim 13, further comprising illuminating the key or the label to indicate a status of the tactile switch element.

* * * * *